US006394099B1

(12) United States Patent
Daley

(10) Patent No.: US 6,394,099 B1
(45) Date of Patent: May 28, 2002

(54) DECORATIVE NAIL FILES INCORPORATING GLITTER AND LUMINESCENT MATERIAL

(76) Inventor: Scott G. Daley, 1751 Baldwin Rd., Ojai, CA (US) 93023

( * ) Notice: Subject to any disclaimer, the term of this patent is extended or adjusted under 35 U.S.C. 154(b) by 0 days.

(21) Appl. No.: 09/712,450

(22) Filed: Nov. 13, 2000

Related U.S. Application Data

(63) Continuation-in-part of application No. 08/961,723, filed on Oct. 31, 1997, now Pat. No. 6,145,512, which is a continuation-in-part of application No. 08/714,235, filed on Sep. 16, 1996, now abandoned, which is a continuation of application No. 08/225,967, filed on Apr. 8, 1994, now abandoned.

(51) Int. Cl.[7] ..... A45D 29/04
(52) U.S. Cl. ..... 132/76.4; 451/539
(58) Field of Search ..... 132/73, 75.8, 76.4, 132/76.5; 451/559, 523, 524, 525, 533, 539

(56) References Cited

U.S. PATENT DOCUMENTS 2,557,175 A * 6/1951 Cortes ..... 132/76.4
2,699,791 A * 1/1955 Hansen ..... 132/76.4
3,656,265 A * 4/1972 Schaffner, Jr. ..... 451/539
4,712,552 A * 12/1987 Pangburn ..... 132/76.4
5,361,786 A * 11/1994 Pangburn ..... 132/76.4
5,658,184 A * 8/1997 Hoopman et al. ..... 451/539
6,027,402 A * 2/2000 Oliver ..... 132/76.4
6,062,967 A * 5/2000 Calafut et al. ..... 451/523

* cited by examiner

*Primary Examiner*—Todd E. Manahan
(74) *Attorney, Agent, or Firm*—Lyon & Lyon LLP

(57) ABSTRACT

The present invention relates to an aesthetically appealing nail file/buffer comprising a core with an abrasive surface on at least one side of the core and a durable, decorative pattern or design. Preferably, the tool has a core which includes a substantially rigid substrate and at least one layer of resilient material laminated to the substrate. Abrasive material is adhered to at least one side of the core, and glitter may be mixed with the abrasive material. The tool preferably includes materials, such as substantially transparent plastics or gels, possibly with colored pigment, which create a unique, attractive nail file. The tool typically includes a colored pattern, preferably by embedding dyes into the hiatused abrasive surface of the tool using sublimation. Alternatively, the tool may incorporate a patterned sheet under the abrasive material, the abrasive material being composed of substantially clear materials allowing the pattern to show therethrough. The sheet may include a reflective metallic or holographic pattern, a luminescent design, or the sheet may be constructed from thermochromic material.

23 Claims, 3 Drawing Sheets

DECORATIVE NAIL FILES INCORPORATING GLITTER AND LUMINESCENT MATERIAL

This application is a continuation-in-part of application Ser. No. 08/961,723, filed Oct. 31, 1997, issuing Nov. 14, 2000 as U.S. Pat. No. 6,145,512, which is a continuation-in-part of application Ser. No. 08/714,235, filed Sep. 16, 1996, now abandoned, which is a file wrapper continuation of application Ser. No. 08/225,967, filed Apr. 8, 1994, now abandoned, the disclosures of which are expressly incorporated herein by reference.

FIELD OF INVENTION

The present invention relates to fingernail and toenail tools, and more particularly to nail files and buffers having colored or decorative designs.

BACKGROUND

Many people accentuate their fingernails and toenails by filing and buffing them. The top surface of a nail is filed and polished using emery boards, and other similar tools, to produce a surface that shines or that can be decorated with color or a design.

A typical tool for filing nails includes a core or base sheet having at least one abrasive surface. The core is typically a flat, substantially rigid sheet, such as paper, wood, plastic, or foam having two sides. A layer of abrasive is adhered to one or both sides to provide the filing or buffing surfaces of the tool. For two-sided tools, the same abrasive grit is usually provided on both sides, although sometimes a finer grain may be used on one side.

Most nail filing tools have a plain appearance, typically the simple gray or tan color of the sandpaper commonly applied to the surfaces. Alternatively, a more attractive file can be created by decorating the sandpaper surface.

Attempts have been made to provide more attractive emery boards by applying dyes to the surface or subsurface of a nail file, with mixed success. For example, conventional dyes may be painted onto the finished surface of an emery board. The necessary abrasion of the file against a nail, however, tends to remove the color applied, resulting in a progressively faded and unattractive file and/or resulting in color being transferred to the nail. Alternatively, colors may be applied to an intermediate surface of the file. After dyes are painted on the intermediate surface, a finish surface including abrasive material is applied. This overlying finish surface, however, may blur or otherwise obstruct the appearance of the design applied, creating a less desirable effect. Additionally, the adhesives required between the intermediate and finish layer may discolor, detracting from the final appearance of the file.

Attempts have been made to add glitter to a nail file to improve its aesthetic appearance. Glitter added to the surface of a file, however, tends to fall off during use, and may compromise the desired abrasive quality of the file. Glitter may be added beneath the abrasive surface of the file, but generally this results in the glitter becoming dull and losing its luster, thereby resulting in a less attractive file.

Accordingly, there is a need for nail files or buffers which have more aesthetically appealing appearances and/or have a colored or decorative pattern that does not wear off during use.

SUMMARY OF THE INVENTION

The present invention is directed to aesthetically appealing tools for filing or buffing natural or artificial fingernails or toenails and to methods of manufacturing such tools. The invention combines a file/buffer with a durable, decorative design, to provide an effective tool which is more attractive to consumers than conventional tools. The present invention also includes materials novel to nail files which further augment the attractiveness of the finished tool.

Broadly, the tool of the present invention has three general layers which are fused together, namely a core layer, a layer of abrasive material, and a colored or decorative layer.

The core layer comprises a substantially rigid substrate, simultaneously providing structural support and flexibility for the tool. The core layer may have a single layer of material such as paper, wood, or plastic. Preferably, the core layer comprises a composite structure, including a substantially rigid core of the materials just described together with one or more layers of a substantially resilient material, such as rubber, gel or foam.

Adhered to the core layer is a layer or sheet of abrasive material which creates a hiatused surface on the outer surface of the tool. The layer of abrasive material typically comprises a base coat, abrasive material, and a sizing coat. The base coat usually constitutes a binding material such as epoxy. Abrasive grit is substantially fused to the base coat, to provide a rough filing surface. Any known abrasive having desired grain sizes is applied, such as powdered glass, flint, garnet or aluminum oxide. A sizing coat is applied, preferably a thin coat of material substantially similar to the base coat. This coating further holds the abrasive grains in place while not significantly diminishing the abrasiveness of the finished surface.

Finally, a colored or decorative layer provides an aesthetic appearance of the tool and can take several forms. The layer involves any material for creating a colored or decorative pattern, such as dyes or paints, or decorative sheets of material, such as paper or fabric. When colored dyes are used, they are preferably applied to the hiatused surface of the tool by sublimation, a process which will be discussed in greater detail below. Alternatively, paper or similar sheet material having a colored or decorative pattern on its top surface are applied between the core layer and the layer of abrasive material. Preferably, this requires the layer or sheet of abrasive material to be substantially transparent to allow the pattern to show through. Furthermore, the decorative layer may be eliminated completely if the materials selected for the core layer and the layer of abrasive material are sufficient to create an aesthetically appealing tool.

In a first preferred embodiment, the invention comprises a substantially opaque nail tool having a colored or decorative pattern printed on its abrasive surface by a process which creates a durable pattern. The core layer is provided from any of the materials previously described, but preferably polystyrene. The layer of abrasive material includes any of the materials just described, although typically the abrasive surface has an opaque white color, preferably obtained by adding white pigment to epoxy resin used for the base and sizing coats, which will not detract substantially from the color resolution of the color pattern applied to the surface.

The colored pattern is applied to this hiatused surface by a process called sublimation. This method is more particularly described in application Ser. No. 08/714,235, the disclosure of which is incorporated herein by reference. In essence, sublimation involves transferring a colored pattern of dyes on a sheet, such as paper, onto the hiatused surface of the tool. The paper and the tool are placed in a press with the pattern on the paper directed towards the hiatused surface of the tool. Heat and pressure are applied which vaporize the dyes on the paper and embed them into the surface of the tool.

In a second preferred embodiment, the invention comprises a nail tool having a unique translucent or transparent appearance. The core layer constitutes one or more materials which are at least partially translucent and preferably substantially transparent. Such materials include clear plastics, gels or rubbers, with styrene, acrylic, or polycarbonate being preferred. The layer or sheet of abrasive material also has a partially translucent and preferably a substantially transparent appearance. This is achieved by using substantially translucent or transparent materials, such as a clear epoxy, or a polyester film, for the base and sizing coats and providing substantially translucent or transparent grit, such as powdered glass or aluminum oxide, for the abrasive. During manufacturing, substantially clear adhesives are used, such as an acrylic adhesive, which substantially will not discolor during the bonding process or over time.

Because of the translucent or transparent materials used, the resulting tool typically has a sufficiently unique appearance as to constitute a finished, attractive product without requiring an added pattern. The materials may be substantially colorless or they may include color, such as by introducing dye or some other pigment into the core layer or the base and/or sizing coats. In addition, powdered glass of a desired color may be selected for the abrasive material to provide additional color effects.

Glitter, such as metalized bits of plastic and/or polished aluminum foil, may also be mixed with the abrasive material. The glitter may be bonded to the base coat, and covered, along with the abrasive material, with a substantially transparent sizing coat. Thus, the glitter substantially maintains its reflective glitter and/or luster through the sizing coat without compromising the abrasive quality of the nail file. In addition, the base coat and/or sizing coat may include a colored dye selected to complement the color and/or reflective quality of the glitter.

Alternatively, a colored or decorative pattern may be applied to the surface of the file using the sublimation process already referenced above.

In a third preferred embodiment, a decorative sheet is fused between the core layer and the layer of abrasive material. The sheet is composed of a durable material, such as paper or fabric, which can resist heat and pressure. The sheet may include such patterns as a reflective metallic or holographic image, or a luminescent design. Optionally, the base and/or sizing coat material may also be colored or particularly reflective abrasive grains may be selected to augment the appearance of the pattern showing through the layer of abrasive material. Finally, the sheet may instead constitute thermochromic material which changes color in response to temperature variations of the material.

Although the manufacturing of the different embodiments involve the game basic processes, the specific parameters vary somewhat because of the different materials used. Generally, the core layer and the layer of abrasive material are laminated together using adhesives that cure when subjected to heat and pressure. A preferred adhesive is one that does not include animal products or other materials that are particularly sensitive to heat and pressure, as well as one that does not include products which may discolor. Examples of acceptable adhesives include acrylic, epoxy, polyvinyl chloride (PVC) acetate, or polyurethane.

When a colored pattern is applied to the surface, the heat and pressure of the sublimation process may be used to cure the adhesives laminating the various layers of the tool. Alternatively, only the layer or sheet of abrasive material is subjected to the sublimation process, and the core layer is bonded to the layer of abrasive material in a subsequent step, which may include additional heat and pressure.

The tool may include a patterned sheet, such as paper, permanently incorporated into the tool between the core and abrasive layers as already described. The sheet is preferably adhered to the core layer before the core layer and the layer of abrasive material are laminated together. The layer of abrasive material, which has a translucent or preferably substantially transparent appearance, is then laminated over the patterned sheet.

More typically, the entire product is cured all at one time, using heat and pressure similar to those described above, bonding all of the layers permanently together in a large sheet. The sheet is then cut using conventional methods, such as die cutting, to form individual nail tools. Thus, the method of manufacturing the present invention provides an efficient means of producing a durable, decorative tool in large enough quantities to reduce manufacturing costs and allow the present invention to compete commercially with inexpensive, but relatively plain, conventional nail files.

Other objects and features of the present invention will become apparent from consideration of the following description taken in conjunction with the accompanying drawings.

BRIEF DESCRIPTION OF TIE DRAWINGS

For a better understanding of the invention, and to show how it may be carried into effect, reference will be made, by way of example, to the accompanying drawings, in which.

DETAILED DESCRIPTION OF THE PREFERRED EMBODIMENTS

Figure 4:
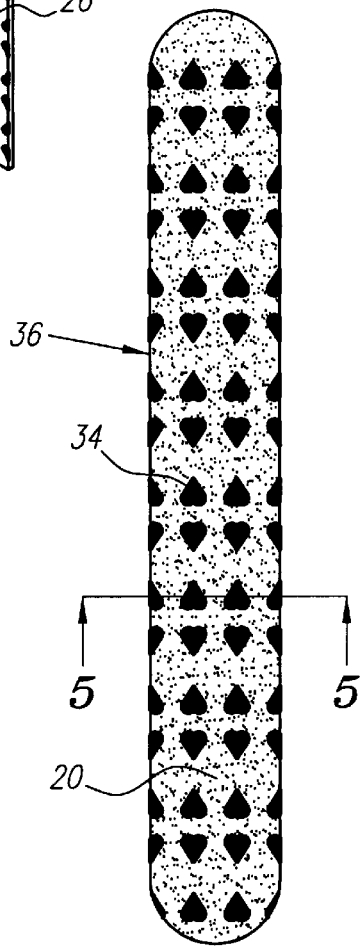
FIG. 4 is a top view of a preferred embodiment of a nail tool of the present invention.
Figure 5:
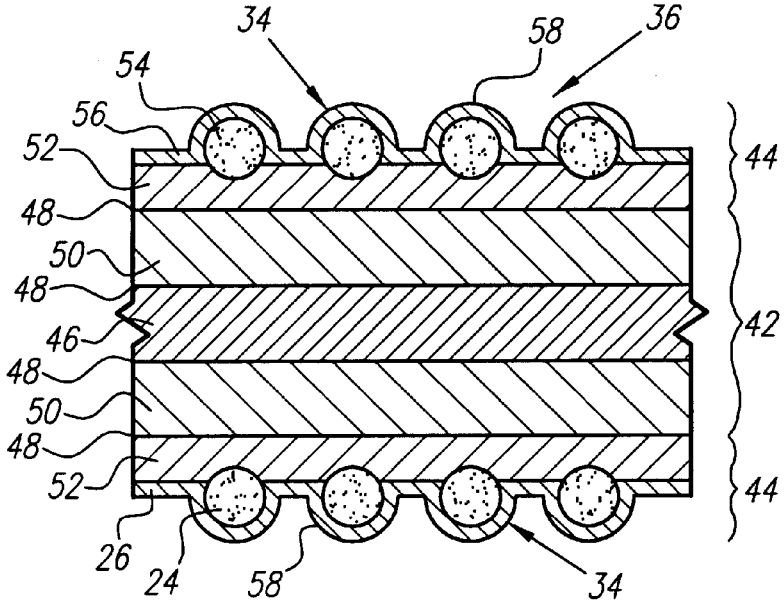
FIG. 5 is a cross-sectional view of a first preferred embodiment of the present invention, along line 5—5 of FIG. 4.

Turning to the drawings, FIGS. 4 and 5 show a preferred embodiment of the present invention, namely a nail file/buffer tool 36. The tool 36 comprises a core layer 42, a layer or sheet of abrasive material 44 on each side of the core layer 42, and a colored or decorative pattern 34 printed onto the outside surfaces 58. Although the presently described preferred embodiment includes abrasive material on two sides of a core, it is understood that abrasive could be present on one or more sides of the core.

The core layer 42 includes a substantially rigid substrate 46 which has a layer of resilient material 50 bonded onto two sides using an adhesive 48. Optionally, the core layer 42 may include only the substrate 46 without the resilient material 50, or the resilient material 50 may be bonded onto one or more sides of the substrate 46, instead of two sides as shown.

Laminated onto both sides of the core layer 42 is a layer or sheet of abrasive material 44. Alternatively, the layer of abrasive material 44 may be applied to only one side of the core layer 42. Each layer of abrasive material 44 includes a base coat 52, abrasive material 54 fused to the base coat 52, and a thin sizing coat 56 applied over the abrasive material 54. Finally, the outside surfaces 58 include a colored or decorative pattern 34.

The substrate 46 is preferably made from any appropriate material which provides substantial support and flexibility, such as paper, wood or plastic. The substrate 46 should readily accept an adhesive 48 required to bond the layers together, and should also exhibit good resistance to heat and pressure encountered during the printing process described below. A substantially opaque plastic, for example, having a thickness ranging from about 0.1 mm to about 15 mm, has been effective for this purpose, with white polyester or polystyrene being preferred.

The optional layer of resilient material 50 preferably includes any cushioning material which allows the tool to contour somewhat to the curvature of a nail during use, but tends thereafter to return to its natural shape. In addition, the resilient material should be compatible with adhesives and should resist heat and pressure similar to the substrate. Suitable materials include foam or rubber available in sheets, for example, having a thickness of between about 1.0 mm and about 50 mm, and most preferably of about 3.0 mm, with polyethylene foam being preferred.

The layer or sheet of abrasive material 44 has a base coat 52 which acts as a binder for the abrasive material 54. The base coat 52 may comprise resins which are opaque or transparent, although the preferred resin is substantially opaque and white to highlight the color characteristics of the pattern applied to the tool. Preferably the base coat has a thickness of between about 0.1 mm and about 15 mm. Polyvinyl chloride acetate provides an effective material because it remains hard and resists heat once it has cured, while epoxy is the preferred material.

The abrasive material 54 inserted or embedded into the base coat 52 includes any known grit materials having desired abrasive characteristics. Appropriate materials include recycled powdered glass, garnet, flint or aluminum oxide. A person reasonably skilled in the art will already be familiar with the properties and characteristics desired in selecting appropriate grit materials for use in nail files.

The sizing coat 56 is applied, e.g. sprayed or brushed, over the abrasive material 54 and preferably comprises a thin layer of substantially the same material as the base coat 52. The sizing coat 56 is thick enough to support the abrasive material 54 attached to the base coat 52, but thin enough not to substantially diminish the desired abrasiveness of the abrasive material 54, for example, between about 5.0 mm and about 10.0 mm, and preferably less than 5.0 mm.

As an alternative to manufacturing the layer of abrasive material 44 from these constituents, commercially available products, such as sandpaper, may be used if it provides a desired abrasiveness, has a substantially opaque white abrasive surface, and has a backing material compatible with the adhesives used to attach the layer of abrasive material 44 to the core layer 42.

The process of manufacturing the nail tool of the first preferred embodiment involves five general steps, namely forming a sheet for the core layer, forming a sheet for the layer of abrasive material, bonding the core layer and the layer of abrasive material, applying a colored or decorative pattern by sublimation, and cutting the sheet into individual nail files.

In the first step, the core layer is generally formed by providing a substrate, and one or more sheets or coats of resilient material. A side of the substrate is coated with a glue or is covered with a transfer film, such as an adhesive film made by 3M. The preferred glue is pressure sensitive, curing when subjected to heat and pressure. Epoxy, PVC acetate, acrylic, and polyurethane provide effective adhesives as they contain no animal products which may be overly sensitive to heat. A water-based acrylic adhesive has been proven to be most effective. A sheet or coat of resilient material is applied to the glued surface, adhering the resilient material to the substrate. If an additional layer of resilient material is desired, either on top of the first layer or on the other side of the substrate, the procedure is repeated, first coating the desired surface with glue and then adding another sheet or coat of resilient material. Finally, the exposed side that will receive the layer of abrasive material is coated with glue and provided with an opportunity to set.

The layer of abrasive material is also formed preferably as a sheet. A base coat is applied preferably to a thin backing material, such as paper or polyester. Grit material is then attached to or embedded into the base coat, preferably using an electrostatic process. The base coat and the grains of the abrasive material are electrostatically charged such that the grains are attracted to the base coat and attach thereto. Preferably, a sizing coat of substantially similar material to the base coat is then applied over the abrasive material and the base coat, creating the outer surface of the tool. The particular methods and parameters involved in making the layer of abrasive materials should already be known to those reasonably skilled in the art of making abrasive sheet materials, such as sandpaper.

The sheet of abrasive material is then laminated to one or more sides of the core layer, creating a tool sheet. The exposed surfaces of the core layer which are coated with glue are laminated to the back of the layer of abrasive material, typically to the backing material of the base coat, or if a commercial product is used, to the back of the sandpaper.

The finished tool sheet then has a colored or decorative pattern applied to its outer surface. Because of the abrasive material, the tool has a rough, hiatused surface, which wears as the tool is used to file nails. For this reason, sublimation is a very effective method of applying a durable pattern to the rough outer surface of the tool sheet. The sublimation process also creates conditions appropriate for curing the adhesives used to bond the layers together.

Figure 1:
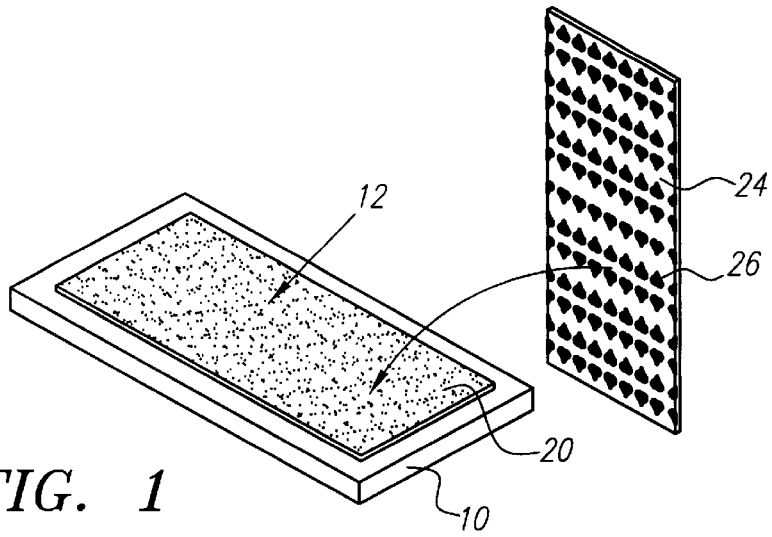
FIG. 1 is an isometric view of a paper sheet with a printed pattern and a tool sheet for nail files being placed on a press in preparation for sublimation.
Figure 2:
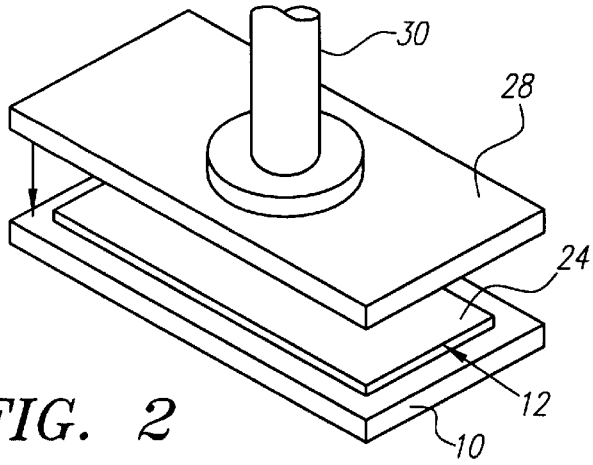
FIG. 2 is an isometric view of a press subjecting the tool sheet and the paper sheet to heat and pressure to induce to sublimation of the printed pattern.
Figure 3:
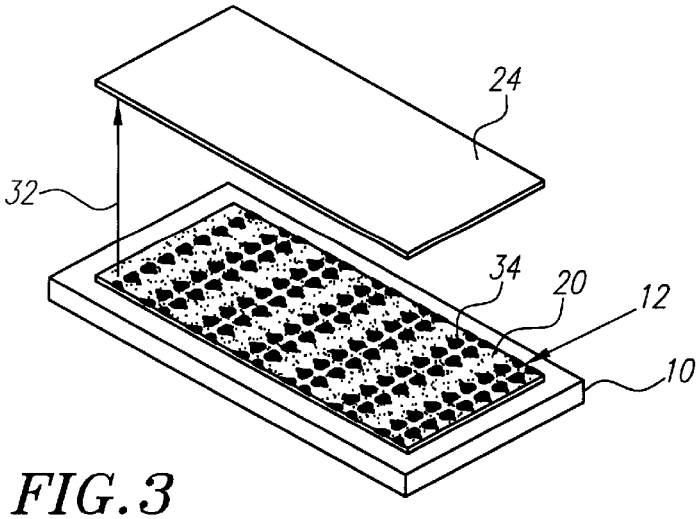
FIG. 3 is an isometric view showing the tool sheet after the press and paper sheet have been lifted and the printed pattern has been transferred to the tool sheet.

Turning to FIGS. 1 to 3, a tool sheet 12 is placed on a horizontal plate 10 with the hiatused surface 20 exposed. The tool sheet may include the entire assembly, as shown in FIG. 5 for example, absent the coating 34, or it may simply comprise the layer of abrasive material 44. A thin paper sheet 24 having a color pattern 26 printed thereon is placed over the tool sheet 12 with the color pattern 26 above and directly adjacent the hiatused surface 20. This orientation provides the best pattern transfer because the dyes being transferred proceed downward in the direction of gravity.

The press 28, such as a hydraulic device 30, then subjects the paper sheet 24 to heat while compressing the tool sheet 12 and the paper sheet 24 together. The heat applied to the paper sheet 12 is typically within a temperature range of between about 150 and about 300 degrees Centigrade. Simultaneously, pressure of between about 1500 and about 4000 pounds per square centimeter is applied via hydraulic drive or ram 30. These conditions are imposed usually for a time of between about five seconds and about two minutes.

Due to the application of heat and pressure, the printed pattern 26 on the paper sheet 24 is vaporized. This vaporization of the dyes from solid to gag is referred to as sublimation. The dye vapor then impregnates the hiatused surface 20 of the tool sheet 12, imprinting the color pattern 34 substantially deeply into the surface 20, typically penetrating to a depth of as much as 80% of the thickness of the abrasive substrate.

The appropriate pressure varies during the sublimation process when different abrasive materials are used for the tool. Fine abrasive materials in the hiatused surface 20, such as those between about 400 and 320 grit, respond better to pressures of about 1500 pounds per square centimeter, while coarser grains, between about 100 and 80 grit for example, require higher pressures around 4000 pounds per square centimeter. A range of pressure of about 2500 to about 3000 pounds per square centimeter is most typically used.

The temperature range applied depends primarily upon the color and/or the type of the dyes used in the printed pattern 26. When the printed pattern 26 includes more red color, lower temperatures, such as around 160 degrees Centigrade, are preferred and should be applied for between about fifteen seconds and about two minutes. Darker colors transfer better when higher temperatures, around 230 degrees Centigrade, are applied for shorter periods of time, typically between about five and thirty seconds. For example, a typical sublimation procedure may occur at 210 degrees Centigrade for twenty to thirty seconds.

After the selected period of time, the press 28 is lifted. The paper sheet 24 is discarded, exposing the tool sheet 12 with the color pattern 34 now embedded into the hiatused surface 20. The tool sheet 12 is then cut, using conventional cutting methods such as die cutting, to produce the individual nail files, such as that illustrated in FIG. 4, which have typical configurations known to those reasonably skilled in the art.

An alternative procedure to that described above may also be used to print the color pattern 34 onto the hiatused surface 20. The layer or sheet of abrasive material 44 without the core layer 42 may be placed in the press so that the sublimation process creates a pre-printed sheet of abrasive material 44 which may thereafter be laminated to the core layer 42 using adhesives, such as those described above. This method does not expose the core layer 42 or the adhesives therein/thereon to the heat and pressure conditions of the sublimation process, reducing the risks of damaging the materials used. However, the adhesives used to laminate the layers typically may require subsequent application of heat and/or pressure to completely cure them and bond the layers together, similar to those previously described.

Figure 6:
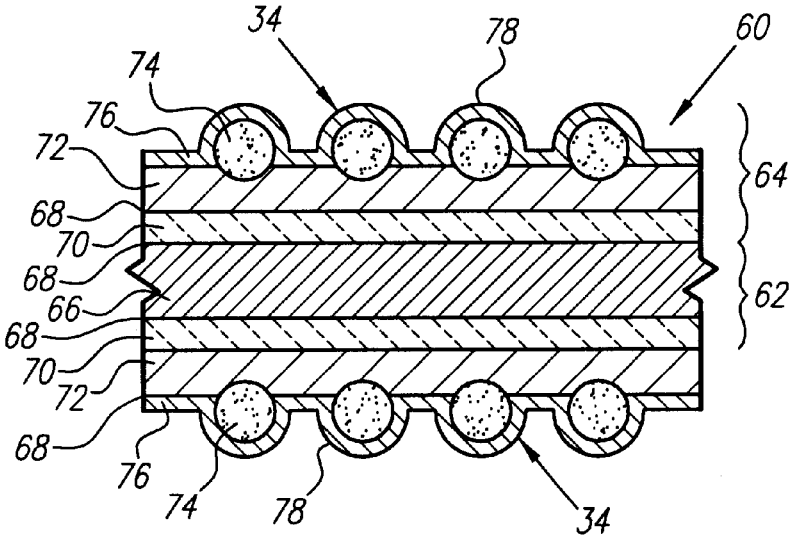
FIG. 6 is a cross-sectional view of a second preferred embodiment of the present invention, along line 5—5 of FIG. 4.

In a second preferred embodiment, the nail tool 60 of FIG. 6 is created from substantially transparent materials creating a unique appearance for a nail file. The core layer 62 of this embodiment preferably comprises a substantially clear plastic substrate 66, such as styrene, acrylic, or polycarbonate. Typically in this embodiment, the core layer 62 does not include a layer of resilient material as provided in the first preferred embodiment, although optionally a layer of preferably substantially clear rubber or gel similar to that discussed below may be included to provide a cushioning layer. The substrate 66 is coated with an adhesive 68 which is also preferably substantially transparent and which does not discolor when subjected to heat and pressure. Most common glues used for emery boards include animal products or similar materials which tend to discolor during the curing process and are, therefore, disfavored. Instead, clear acrylic adhesive is preferred as it provides good adhesive characteristics while substantially maintaining its clarity.

The layer of abrasive material 64 preferably includes a backing material 70, a base coat 72, abrasive material 74, and a sizing coat 76. Unlike conventional sandpaper, which includes an opaque paper backing and often opaque abrasive grains, the present invention preferably comprises a substantially clear film for the backing material 70, such as a polyester-based film which is substantially transparent, and substantially clear materials for the abrasive material, such as powdered glass. The base coat 72, preferably a substantially clear epoxy, is applied to the backing material 70. The abrasive material 74 is attached to the base coat 72 using known procedures, such as the electrostatic process already described. A substantially clear sizing coat 76 is then applied over the abrasive material 74.

The resulting composition is a translucent or preferably substantially transparent layer, ready to receive a printed pattern. After the layer of abrasive material 64 is laminated onto one or more sides of the core layer 62, or optionally before they are laminated, the colored or decorative pattern 34 is printed onto the outer surface 78 using the sublimation process described above.

Alternatively, the tool 60 of FIG. 6 may be provided with the sizing coat 76 as the finished surface without a colored pattern. In this embodiment, the core layer 62 typically includes one or more layers of resilient material (not shown) applied to the substrate 66. To maintain the substantially transparent appearance of the finished tool while still providing a cushioning layer, soft translucent or substantially transparent rubber or gel is preferably used for the layer of resilient material. For example, a plastisol which is applied as a liquid and cures into a gelatinous solid may be used. To cure the adhesive and gel, the tool is typically subjected to heat and/or pressure similar to that previously described.

In other variations of this embodiment, the base coat 72 and/or the sizing coat 76 preferably have color included in them. For example, a luminescent pigment or dye may be mixed with a substantially clear epoxy to provide a nail tool that glows in the dark. The core layer may be substantially transparent as already described, or it may be substantially opaque depending upon the effect preferred for the finished tool.

Figure 7:
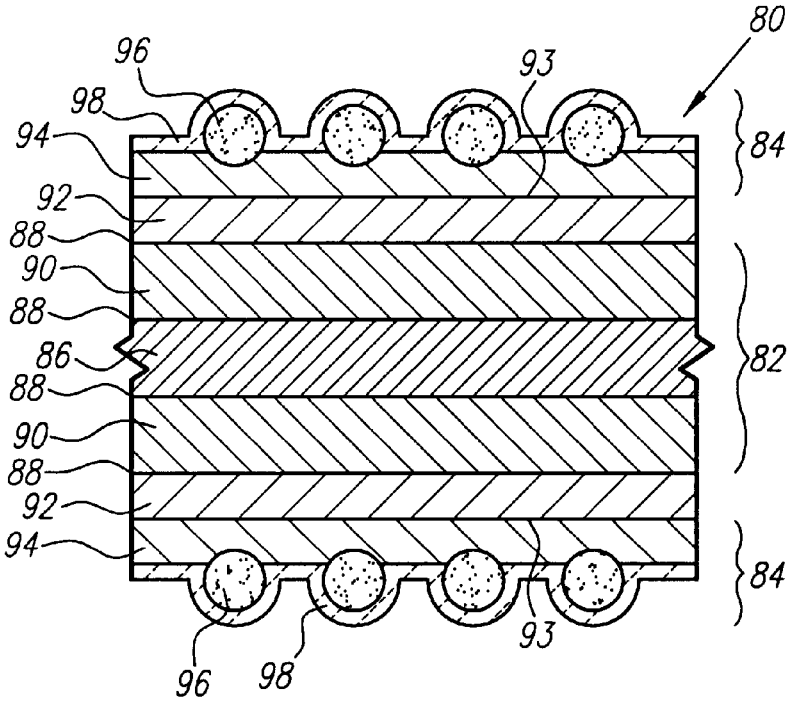
FIG. 7 is a cross-sectional view of a third preferred embodiment of the present invention, along line 5—5 of FIG. 4.

In a third embodiment, shown in FIG. 7, the tool 80 comprises a core layer 82, a colored sheet 92, and a layer of abrasive material 84. Similar to the tools previously described, the core layer 82 preferably includes a substrate 86 with a layer of resilient material 90 laminated onto both sides of the substrate 86 using adhesive 88. Preferably, the material and assembly of the core layer 82 are substantially similar to that for the tools already described.

The tool 80 also has a layer of abrasive material 84, which includes a base coat 94, abrasive material 96, and a sizing coat 98. The materials for this layer-preferably include the substantially translucent or transparent materials previously described.

However, unlike the previous embodiments, this embodiment preferably includes a thin patterned sheet 92 having a colored or decorative pattern on its outside surface 93 laminated between the core layer 82 and the layer of abrasive material 84. Because the sheet is sandwiched between these layers, the material used should preferably be resistant to heat and pressure and should preferably bond well with the adhesives which have already been described. Paper with dyes or paints in a pre-made decorative pattern is preferred for this sheet. The pattern may include a reflective metallic design or a luminescent image applied to the outside surface 93 using conventional methods.

Alternatively, the patterned sheet 92 may comprise a thermochromic material which changes color subject to fluctuations in temperature, such as when the surface is touched by warm fingers or when heat is generated by friction created when filing. If a thermochromic sheet is used, it is preferred that the core layer comprise a substantially opaque black material to enhance the dramatic effect of the thermochromic changes in the sheet.

The patterned sheet 92 is laminated to the core layer 82 using any of the adhesives already discussed. The layer of abrasive material 84 is preferably laminated to the patterned sheet 92 using a substantially clear adhesive, such as the clear acrylic already described, to allow the patterned sheet 92 to be substantially visible through the layer of adhesive material 84. In addition, the base coat 94 and/or the sizing coat 98 may include a color to augment the colored pattern on the patterned sheet 92. Where the colored pattern comprises a reflective metallic design, abrasive material, such as powdered glass, which exhibits superior reflective characteristics may be selected to enhance the reflective appearance of the finished tool. Once the layers are laminated together, typically they are subjected to heat and pressure to bond the paper sheet to the core and the abrasive material, similar to the process described previously.

Figure 8:
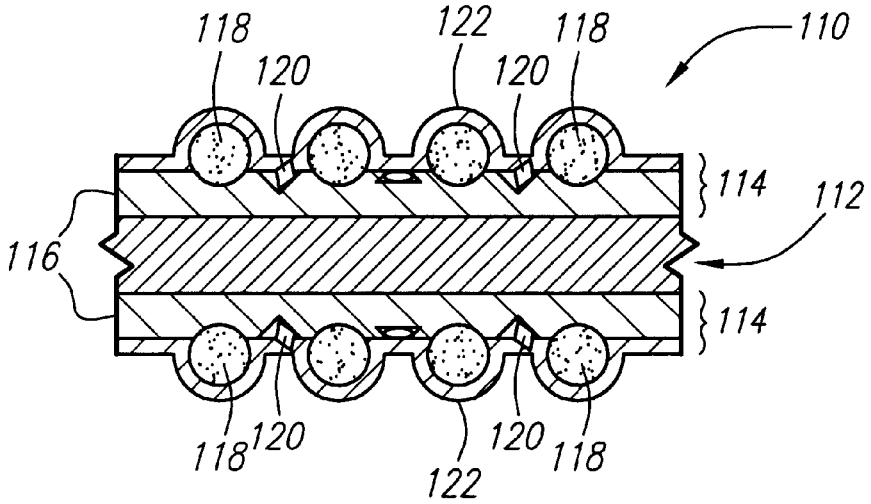
FIG. 8 is a cross-sectional view of a fourth preferred embodiment of a nail file in accordance with the present invention.

Turning to FIG. 8, another preferred embodiment of a nail file 110, in accordance with the present invention, is shown. The nail file includes a substrate or core layer 112, similar to those described above, onto which a layer of abrasive material 114 is applied, for example, by bonding with an adhesive or otherwise as described above for the previous embodiments.

The layer of abrasive material 114 includes a base coat 116 to which abrasive grains 118 and glitter 120 are bonded. At least one sizing coat 122, preferably of a substantially transparent material, is provided over the abrasive grains 118 and glitter 120. The abrasive grains 118 are preferably glass or aluminum oxide.

The glitter 120 may be metalized bits of plastic, polished and/or anodized aluminum foil, or any other material that provides a reflective glitter and/or luster. The glitter 120 may be punched or otherwise cut from thin, flat sheets into relatively small pieces in a variety of shapes, such as circles, squares, diamonds or triangles. The base coat 116 may also be substantially transparent and/or may include a selected color, such as a colored dye, therein that complements the color of the glitter 120, thereby highlighting the reflective quality of the glitter 120. Optionally, the sizing coat 122 may also include a color therein that complements the glitter 120.

To make the layer of abrasive material 114, dry abrasive grains 118 are mixed with the glitter 120. The mixed abrasive grains 118 and glitter 120 are bonded to the base coat 116, for example, using one of the methods described above. The sizing coat 122 is then applied, e.g., brushed or sprayed, over the base coat 116 to further secure the abrasive grains 118 and the glitter 120. Thus, the glitter 120 is not located on an outer surface of the layer of abrasive material 114, where it may easily fall off during use of the nail file, but is protected beneath the sizing coat 122. Further, the glitter is not buried beneath the base coat 116 where its reflective glitter qualities may be compromised, but it is mixed with the abrasive grains to maximize the glitter effect.

The mixed abrasive grains 118, glitter 120, base coat 116 and sizing coat 122 may be cured together, i.e., formed into a finished layer of abrasive material 114. The layer of abrasive material 114 may then be attached to the core layer 112, for example, using an adhesive, such as a substantially transparent epoxy. Alternatively, the base coat 116 may be initially applied to the core layer 112, and then the mixed abrasive grains 118 and glitter 120 may be bonded to the base coat 116. Thereafter, one or more sizing coats 122 may be applied over the abrasive grains 118, glitter 120 and base coat 116. The entire nail tool 110 may then be cured, for example, using heat and/or pressure, similar to the methods described above, as will be appreciated by those skilled in the art.

While embodiments of the present invention have been shown and described, various modifications may be made without departing from the scope of the present invention, and all such modifications and equivalents are intended to be covered.

I claim:

1. A nail tool having a durable, aesthetically attractive design, comprising:

a core layer having at least one side;

a layer of abrasive material on at least one side of said core layer, the abrasive material comprising a plurality of abrasive grains and glitter mixed together, and a base coat to which the abrasive grains and glitter are bonded.

2. The nail tool of claim 1, wherein the base coat comprises a color selected to complement the glittering of the glitter.

3. The nail tool of claim 1, wherein the base coat is substantially transparent.

4. The nail tool of claim 1, wherein the glitter comprises metalized bits of plastic.

5. The nail tool of claim 1, wherein the glitter comprises pieces of polished or anodized aluminum.

6. The nail tool of claim 1, wherein the abrasive grains comprise glass.

7. The nail tool of claim 1, wherein the abrasive grains comprise aluminum oxide.

8. The nail tool of claim 1, wherein the layer of abrasive material further comprises a substantially transparent sizing coat covering the base coat, the abrasive grains and the glitter.

9. The nail tool of claim 8, wherein the sizing coat comprises a color selected to complement the glittering of the glitter.

10. A method for making a decorative nail tool, comprising the steps of:

providing a core layer comprising at least one side;

mixing dry abrasive grains and glitter material together;

bonding the mixed dry abrasive grains and glitter material to the side of the core layer; and covering the mixed dry abrasive grains and glitter material with a substantially transparent sizing coat, the glitter material being substantially visible through the sizing coat.

11. The method of claim 10, wherein the sizing coat comprises a color selected to complement the glittering of the glitter material.

12. The method of claim 10, wherein the mixed dry abrasive grains and glitter material are bonded to a base coat prior to being bonded to the side of the core layer.

13. The method of claim 12, wherein the base coat comprises a color selected to complement the glittering of the glitter material.

14. The method of claim 12, wherein the mixed dry abrasive grains and glitter material, base coat and sizing coat are cured together to form a layer of abrasive material prior to being bonded to the side of the core layer.

15. The method of claim 14, wherein the layer of abrasive material is bonded to the side of the core layer by an adhesive.

16. A luminescent nail tool, comprising:

a substantially rigid core layer having at least one side, and a layer of abrasive material on at least one side of the core layer, the layer of abrasive material having an outer sizing coat comprising luminescent material therein.

17. The luminescent nail tool of claim 16, wherein the layer of abrasive material further comprises a base coat comprising luminescent material therein.

18. The luminescent nail tool of claim 17, wherein at least one of the sizing coat and the base coat is substantially transparent.

19. A method of manufacturing a nail tool having a durable, colored pattern printed thereon, comprising the steps of:

providing a substantially transparent core, laminating a layer of abrasive material to the substantially transparent core using a substantially transparent adhesive, the layer of abrasive material comprising a base coat and a sizing coat that are at least substantially translucent, and sublimationally printing a colored pattern onto the layer of abrasive material while substantially maintaining the clarity of materials underlying the colored pattern.

20. The method of claim 19, wherein the step of sublimationally printing a colored pattern comprises the steps of:

providing a sheet imprinted with a colored pattern, covering the substantially transparent abrasive material with the colored pattern on the sheet, and applying heat and pressure to the sheet, thereby causing the colored pattern to vaporize and transfer to the substantially transparent abrasive material.

21. The method of claim 19, wherein the materials comprising the layer of abrasive material are substantially transparent.

22. The method of claim 19, wherein the layer of abrasive material is laminated to the substantially transparent core using a substantially transparent adhesive.

23. The method of claim 22, wherein the adhesive is substantially cured under heat and pressure during said printing step while substantially maintaining the clarity of the adhesive.

* * * * *